US008055397B2

(12) United States Patent
Pathak et al.

(10) Patent No.: US 8,055,397 B2
(45) Date of Patent: Nov. 8, 2011

(54) SYSTEM AND METHOD FOR COMPUTING RAIL CAR SWITCHING SEQUENCE IN A SWITCHYARD

(75) Inventors: Anshu Pathak, Dollard-des-Ormeaux (CA); Matthew Barker, Sherwood Park (CA)

(73) Assignee: Canadian National Railway Company, Montreal, Quebec (CA)

( * ) Notice: Subject to any disclaimer, the term of this patent is extended or adjusted under 35 U.S.C. 154(b) by 977 days.

(21) Appl. No.: 11/601,338

(22) Filed: Nov. 17, 2006

(65) Prior Publication Data

US 2008/0119973 A1 May 22, 2008

Related U.S. Application Data

(63) Continuation-in-part of application No. 11/387,347, filed on Mar. 23, 2006.

(60) Provisional application No. 60/754,601, filed on Dec. 30, 2005.

(51) Int. Cl.
*G05D 1/00* (2006.01)

(52) U.S. Cl. ..... 701/19; 246/108; 246/122 R; 104/26.1; 104/30; 104/31; 340/995.1

(58) Field of Classification Search ..... 701/19, 701/36; 246/2 R, 122 R, 108; 340/995.1; 104/26.1, 30–3
See application file for complete search history.

(56) References Cited

U.S. PATENT DOCUMENTS 1,681,131 A 8/1928 Prescott
2,910,578 A 10/1959 Karlet et al.
3,316,400 A 4/1967 Dosch et al.
3,727,559 A 4/1973 McCune et al.
3,736,420 A 5/1973 Elder et al.
3,861,316 A 1/1975 Yamazaki et al.
3,865,042 A 2/1975 DePaola et al.
3,944,986 A * 3/1976 Staples ..... 104/88.04
3,946,973 A 3/1976 Budway et al.
4,028,531 A * 6/1977 Cottin et al. ..... 701/300
4,034,677 A 7/1977 Frank
4,151,969 A 5/1979 Wood
4,361,300 A 11/1982 Rush
4,610,206 A 9/1986 Kubala et al.

(Continued)

FOREIGN PATENT DOCUMENTS

CA 1 253 244 4/1989

(Continued)

OTHER PUBLICATIONS

Rynsord: a novel decentralized algorithm for railway networks with "soft reservation"; Lee, T.S.; Ghosh, S.; Vehicular Technology, IEEE Transactions on; vol. 47, Issue 4, Nov. 1998 pp. 1350-1364; Digital Object Identifier 10.1109/25.728526.*

(Continued)

*Primary Examiner* — Cuong H Nguyen
(74) *Attorney, Agent, or Firm* — Ladas & Parry LLP

(57) ABSTRACT

As embodied and broadly described herein the invention includes a system for computing a preferred sequence in which cars in a switching queue of a railway switchyard are to be sequentially switched to classification tracks. The system has a processing entity for determining within a given set of cars at least two possible sequences in which the cars in the set can be switched and applying logic rules for identifying among the sequences a preferred sequence. The system also has an output for releasing data describing the preferred sequence.

23 Claims, 4 Drawing Sheets

U.S. PATENT DOCUMENTS

| | | | | |
|---|---|---|---|---|
| 4,883,245 | A | 11/1989 | Erickson, Jr. | |
| 5,129,605 | A | 7/1992 | Burns et al. | |
| 5,465,926 | A | 11/1995 | Brown | |
| 5,499,583 | A | 3/1996 | Blumel | |
| 5,623,413 | A | 4/1997 | Matheson et al. | |
| 5,794,172 | A | 8/1998 | Matheson et al. | |
| 6,076,067 | A | 6/2000 | Jacobs et al. | |
| 6,135,396 | A | 10/2000 | Whitfield et al. | |
| 6,154,735 | A | 11/2000 | Crone | |
| 6,304,801 | B1 | 10/2001 | Doner | |
| 6,377,877 | B1 | 4/2002 | Doner | |
| 6,397,130 | B1 | 5/2002 | Carr et al. | |
| 6,418,854 | B1 | 7/2002 | Kraft | |
| 6,516,727 | B2 | 2/2003 | Kraft | |
| 6,519,595 | B1 | 2/2003 | Rose | |
| 6,587,738 | B1 | 7/2003 | Belcea | |
| 6,637,343 | B2 | 10/2003 | Stephan et al. | |
| 6,766,228 | B2 | 7/2004 | Chirescu | |
| 6,789,005 | B2 | 9/2004 | Hawthorne | |
| 6,832,204 | B1 | 12/2004 | Doner | |
| 6,856,865 | B2 | 2/2005 | Hawthorne | |
| 6,876,300 | B2 | 4/2005 | Ponziani | |
| 6,903,658 | B2 | 6/2005 | Kane et al. | |
| 6,961,682 | B2 | 11/2005 | Doner | |
| 7,006,957 | B2 | 2/2006 | Doner | |
| 7,239,943 | B2 | 7/2007 | Peltz | |
| 7,350,754 | B2 | 4/2008 | Pierson | |
| 7,353,093 | B2 | 4/2008 | Bamfield et al. | |
| 7,433,766 | B2 | 10/2008 | Ruckser | |
| 7,441,506 | B2 | 10/2008 | Bruns | |
| 7,457,691 | B2 | 11/2008 | Muinonen et al. | |
| 7,546,185 | B2 * | 6/2009 | Muinonen et al. | 701/19 |
| 7,657,348 | B2 | 2/2010 | Muinonen et al. | |
| 7,751,952 | B2 | 7/2010 | Muinonen et al. | |
| 7,792,616 | B2 * | 9/2010 | Muinonen et al. | 701/19 |
| 7,813,846 | B2 * | 10/2010 | Wills et al. | 701/19 |
| 7,818,101 | B2 * | 10/2010 | Muinonen et al. | 701/19 |
| 7,885,736 | B2 * | 2/2011 | Muinonen et al. | 701/19 |
| 7,937,193 | B2 * | 5/2011 | Philp et al. | 701/19 |
| 2001/0034642 | A1 | 10/2001 | Doner | |
| 2002/0045975 | A1 | 4/2002 | Carr et al. | |
| 2002/0082814 | A1 * | 6/2002 | Doner | 703/6 |
| 2002/0096081 | A1 * | 7/2002 | Kraft | 104/26.1 |
| 2002/0128757 | A1 | 9/2002 | Chirescu | |
| 2002/0173884 | A1 | 11/2002 | Clawson | |
| 2003/0093195 | A1 | 5/2003 | Ishikawa | |
| 2003/0105561 | A1 | 6/2003 | Nickles et al. | |
| 2003/0236598 | A1 | 12/2003 | Villarreal Antelo et al. | |
| 2004/0015276 | A1 | 1/2004 | Kane et al. | |
| 2004/0030466 | A1 | 2/2004 | Rezk | |
| 2004/0104784 | A1 | 6/2004 | Enriquez | |
| 2004/0111309 | A1 | 6/2004 | Matheson et al. | |
| 2004/0167687 | A1 | 8/2004 | Kornick et al. | |
| 2005/0209777 | A1 | 9/2005 | Peltz | |
| 2005/0240289 | A1 | 10/2005 | Hoyte et al. | |
| 2005/0240545 | A1 | 10/2005 | Schachtely et al. | |
| 2005/0262236 | A1 | 11/2005 | Schachtely et al. | |
| 2006/0027133 | A1 | 2/2006 | Suematsu | |
| 2006/0212184 | A1 | 9/2006 | Philp et al. | |
| 2007/0005200 | A1 | 1/2007 | Wills et al. | |
| 2007/0150130 | A1 | 6/2007 | Welles et al. | |
| 2007/0156300 | A1 | 7/2007 | Muinonen et al. | |
| 2007/0156302 | A1 | 7/2007 | Muinonen et al. | |
| 2007/0156303 | A1 | 7/2007 | Muinonen et al. | |
| 2007/0156304 | A1 | 7/2007 | Muinonen et al. | |
| 2007/0156307 | A1 | 7/2007 | Muinonen et al. | |
| 2007/0156309 | A1 | 7/2007 | Muinonen et al. | |
| 2007/0179688 | A1 | 8/2007 | Muinonen et al. | |
| 2007/0299570 | A1 | 12/2007 | Muinonen et al. | |
| 2008/0119973 | A1 | 5/2008 | Pathak et al. | |
| 2010/0114810 | A1 | 5/2010 | Hoyte et al. | |

FOREIGN PATENT DOCUMENTS

| | | | |
|---|---|---|---|
| CA | 1 269 749 | | 5/1990 |
| CA | 1 293 960 | | 1/1992 |
| CA | 2 143 875 | | 9/1998 |
| CA | 2 291 057 | | 11/1998 |
| CA | 2 175 776 | | 1/2001 |
| CA | 2 382 972 | | 3/2001 |
| CA | 2 395 062 | | 7/2001 |
| CA | 2 395 064 | | 7/2001 |
| CA | 2 395 065 | | 7/2001 |
| CA | 2 395 395 | | 7/2001 |
| CA | 2 395 821 | | 7/2001 |
| CA | 2 356 760 | | 3/2002 |
| CA | 2 364 152 | | 5/2002 |
| CA | 2 364 153 | | 5/2002 |
| CA | 2 364 155 | | 5/2002 |
| CA | 2 364 157 | | 5/2002 |
| CA | 2 429 520 | | 5/2002 |
| CA | 2 198 855 | | 6/2002 |
| CA | 2 431 868 | | 7/2002 |
| CA | 2 413 080 | | 8/2002 |
| CA | 2 433 737 | | 8/2002 |
| CA | 2 374 166 | | 9/2002 |
| CA | 2 196 631 | | 11/2002 |
| CA | 2 279 528 | | 11/2002 |
| CA | 2 476 400 | | 8/2003 |
| CA | 2 484 720 | | 11/2003 |
| CA | 2 486 532 | | 11/2003 |
| CA | 2 494 145 | | 2/2004 |
| CA | 2 449 181 | | 5/2004 |
| CA | 2 500 797 | | 5/2004 |
| CA | 2 454 739 | | 7/2004 |
| CA | 2 459 212 | | 8/2004 |
| CA | 2 459 213 | | 8/2004 |
| CA | 2 431 636 | | 12/2004 |
| CA | 2 281 604 | | 4/2005 |
| CA | 2 281 683 | | 11/2005 |
| CN | 1176907 | A * | 3/1998 |
| JP | 05278504 | A * | 10/1993 |
| WO | WO 02/42142 | | 5/2002 |
| WO | WO 03/090397 | | 10/2003 |
| WO | WO 2004/074067 | | 9/2004 |
| WO | WO 2004/074068 | | 9/2004 |

OTHER PUBLICATIONS

Train queue processing for highly scalable switch fabric design; Chunhua Hu; Saidi, H.; Jeong Gyu Lee; Yan, P.; Min, P.S.; Global Telecommunications Conference, 2001. Globecom '01. IEEE; vol. 4, Nov. 25-29, 2001 pp. 2088-2092 vol. 4 Digital Object Identifier 10.1109/GLOCOM.2001.966149.*

Design of multivoltage locos for international service; Simpson, D.E.; King, A.S.; Siddall, R.B.; Main Line Railway Electrification, 1989., International Conference on; Sep. 25-28, 1989 pp. 88-92.*

YardSim: A rail yard simulation framework and its implementation in a major railroad in the U.S.; Lin, E.; Cheng, C.; Winter Simulation Conference (WSC), Proceedings of the 2009 ; Digital Object Identifier: 10.1109/WSC.2009.5429654; Publication Year: 2009 , pp. 2532-2541.*

Chunhua Hu, et al; "Train Queue Processing for Highly Scalable Switch Fabric Design", Global Telecommunications Conference, GLOBECOM '01. IEEE, vol. 4, pp. 2088-2092, Nov. 25-29, 2001.*

Shiwei He, et al; "Optimal Computer-Aided Dispatching Model of Decision Support System in Railyards", 1997 IEEE International Conference on Intelligent Processing Systems, Oct. 28-31, 1997, Beijing, China, vol. 2, pp. 1546-1550.*

USPTO Office Action mailed Feb. 23, 2009 for U.S. Appl. No. 11/387,290.

USPTO Office Action mailed Apr. 4, 2008 for U.S. Appl. No. 11/387,290.

USPTO Office Action mailed Nov. 18, 2008 for U.S. Appl. No. 11/387,290.

USPTO Office Action mailed Mar. 10, 2009 for U.S. Appl. No. 11/387,297.

USPTO Office Action mailed May 9, 2008 for U.S. Appl. No. 11/387,297.

USPTO Office Action mailed Sep. 16, 2009 for U.S. Appl. No. 11/387,297.

USPTO Office Action mailed Jul. 22, 2009 for U.S. Appl. No. 11/387,347.

USPTO Office Action mailed Sep. 14, 2009 for U.S. Appl. No. 11/387,348.
USPTO Office Action mailed Mar. 10, 2009 for U.S. Appl. No. 11/387,364.
USPTO Office Action mailed May 1, 2008 for U.S. Appl. No. 11/387,364.
USPTO Office Action mailed Oct. 9, 2009 for U.S. Appl. No. 11/387,364.
USPTO Office Action mailed Feb. 2, 2009 for U.S. Appl. No. 11/387,370.
USPTO Office Action mailed Apr. 15, 2009 for U.S. Appl. No. 11/387,370.
USPTO Office Action mailed Jul. 15, 2009 for U.S. Appl. No. 11/387,370.
USPTO Office Action mailed Oct. 16, 2007 for U.S. Appl. No. 11/387,370.
USPTO Office Action mailed Mar. 12, 2009 for U.S. Appl. No. 11/387,373.
USPTO Office Action mailed May 2, 2008 for U.S. Appl. No. 11/387,373.
USPTO Office Action mailed Sep. 16, 2009 for U.S. Appl. No. 11/387,373.
USPTO Office Action mailed Mar. 12, 2009 for U.S. Appl. No. 11/387,474.
USPTO Office Action mailed May 5, 2008 for U.S. Appl. No. 11/387,474.
USPTO Notice of Allowance mailed Oct. 1, 2009 for U.S. Appl. No. 11/387,474.
USPTO Notice of Allowance mailed Sep. 22, 2008 for U.S. Appl. No. 11/387,570.
USPTO Office Action mailed Oct. 16, 2007 for U.S. Appl. No. 11/387,570.
USPTO Notice of Allowance mailed Mar. 11, 2009 for U.S. Appl. No. 11/387,833.
USPTO Office Action mailed Sep. 24, 2008 for U.S. Appl. No. 11/387,833.
USPTO Office Action mailed May 1, 2008 for U.S. Appl. No. 11/388,041.
USPTO Office Action mailed Aug. 12, 2009 for U.S. Appl. No. 11/388,041.
USPTO Office Action mailed Jan. 23, 2009 for U.S. Appl. No. 11/388,062.
USPTO Office Action mailed Apr. 30, 2008 for U.S. Appl. No. 11/388,062.
USPTO Notice of Allowance mailed May 19, 2009 for U.S. Appl. No. 11/388,062.
USPTO Office Action mailed Jun. 18, 2009 for U.S. Appl. No. 11/388,062.
USPTO Notice of Allowance mailed Mar. 23, 2009 for U.S. Appl. No. 11/388,129.
USPTO Office Action mailed Oct. 8, 2008 for U.S. Appl. No. 11/388,129.
Beth C. Kulick, et al; "A Flexible Interface and Architecture for Container and Intermodal Freight Simulations", Proceedings of the 1999 Winter Simulation Conference, Dec. 5-8, 1999, vol. 2, pp. 1238-1242.
Shiwei He, et al; "Optimal Computer-Aided Dispatching Model of Decision Support System in Railyards", 1997 IEEE International Conference on Intelligent Processing Systems, Oct. 28-31, 1997, Beijing, China, vol. 2, pp. 1546-1550.
Donald E. Brown, et al; "Rail Network Routing and Scheduling Using Simulated Annealing", IEEE International Conference on Man and Cybernetics, Oct. 18-21, 1992, vol. 1, pp. 589-592.
Roger D. Burns, et al "Safety and Productivity Improvement of Railroad Operations by Advanced Train Control Systems", Railroad Conference, 1989 Proceedings, Technical Papers presented at the 1989 IEEE/ASME Joint: Apr. 25-27, 1989; pp. 33-38.
USPTO OA mailed Dec. 7, 2010 in connection with U.S. Appl. No. 11/387,290.
USPTO OA mailed Dec. 8, 2010 in connection with U.S. Appl. No. 12/637,965.
USPTO OA mailed Feb. 15, 2011 in connection with U.S. Appl. No. 11/702,864.
USPTO NOA mailed Mar. 21, 2011 in connection with U.S. Appl. 12/777,426.
M.A. Schlenker; Improving Railroad Performance Using Advanced Service Design Techniques: Analyzing the Operating Plan at CSX Transportation, May 1995, pp. 83-110, in U.S. Appl. No. 11/702,864.
A Rubaai; "A neural-net-based device for monitoring Amtrak rail-road track system", Industry Applications, IEEE Transactions on vol. 39, Issue 2, Digital Object Identifier: 10.1109/TIA.2003.809443; Publication Year 2003, pp. 374-381 in U.S. Appl. No. 11/702,864.
A Rubaai, et al; "Design of a neuron-classifier/detector for Amtrak rail-road track operations", Industry Applications Conference, 1998; 33rd IAS Annual Meeting. The 1998 IEEE; vol. 3; Digital Object Identifier: 10.1109/IAS.1998.729801; Publication Year 1998, pp. 1703-1708 in U.S. Appl. No. 11/702,864.
W.E.L. Grimson, et al; "Using adaptive tracking to classify and monitor activities in a site", Computer Vision and Pattern Recognition, 1998, Proceedings 1998 IEEE Computer Society Conference on; Digital Object Identifier: 10.1109/CVPR.1998.698583; Publication Year 1998, pp. 22-29 in U.S. Appl. No. 11/702,864.
USPTO OA mailed Mar. 23, 2010 in connection with U.S. Appl. No. 11/387,347.
USPTO OA mailed Apr. 7, 2010 in connection with U.S. Appl. No. 11/387,347.
USPTO OA mailed Mar. 30, 2010 in connection with U.S. Appl. No. 11/387,364.
USPTO NOA mailed May 27, 2010 in connection with U.S. Appl. No. 11/387,364.
USPTO NOA mailed Feb. 19, 2010 in connection with U.S. Appl. No. 11/387,370.
USPTO NOA mailed Mar. 2, 2010 in connection with U.S. Appl. No. 11/387,297.
USPTO OA mailed Dec. 18, 2010 in connection with U.S. Appl. No. 11/387,290.
USPTO NOA mailed Mar. 16, 2010 in connection with U.S. Appl. No. 11/387,373.
USPTO OA mailed Jan. 12, 2010 in connection with U.S. Appl. No. 11/388,041.
USPTO NOA mailed Apr. 29, 2010 in connection with U.S. Appl. No. 11/388,041.
USPTO NOA mailed Feb. 16, 2010 in connection with U.S. Appl. No. 11/387,348.
USPTO OA mailed May 14, 2010 in connection with U.S. Appl. No. 11/702,864.
USPTO OA mailed Jun. 8, 2010 in connection with U.S. Appl. No. 11/387,290.

* cited by examiner

SYSTEM AND METHOD FOR COMPUTING RAIL CAR SWITCHING SEQUENCE IN A SWITCHYARD

CROSS-REFERENCE TO RELATED APPLICATION

This application is also a continuation-in-part application claiming the benefit of priority under 35 USC §120 of U.S. patent application Ser. No. 11/387,347 filed Mar. 23, 2006 by Kari Muinonen et al., and presently pending, which claims the benefit of priority on U.S. provisional application Ser. No. 60/754,601 filed Dec. 30, 2005. The contents of the above-mentioned patent application are incorporated herein by reference.

FIELD OF THE INVENTION

The invention relates to a process for managing operations in a railroad switchyard. The invention also encompasses a technological platform and individual components thereof to implement the process.

BACKGROUND OF THE INVENTION

A railroad network normally contains one or more switchyards in which cars are routed from tracks leading from a departure point to tracks going to a destination point. A typical switchyard has four main components, namely receiving tracks, a car switching mechanism, a set of classification tracks and a set of departure tracks. Incoming trains deliver cars in the receiving tracks. The cars are processed by the switching mechanism that routes individual cars to respective classification tracks.

Two types of switching mechanisms are in use today. The first one is a hump switch. Switchyards that use a hump switch are referred to as hump yards. A hump switchyard uses a hump over which a car is pushed by a locomotive. At the top of the hump the car is allowed to roll on the other side of the hump under the effect of gravity. Retarders keep the car from reaching excessive speeds. The hump tracks on which the car rolls down the hump connect with the classification tracks. A track switch establishes a temporary connection between the hump tracks and a selected one of the classification tracks such that the car can roll in the classification tracks. A departure train is constituted when the requisite number of cars has been placed in a set of classification tracks. When the departure train leaves the switchyard, the set of classification tracks become available for building a new departure train.

The second type of switch mechanism is a flat switch. The principle is generally the same as a hump yard except that instead of using gravity to direct cars to selected classification tracks, a locomotive is used to push the car from the receiving tracks to the selected set of classification tracks.

In order to increase the efficiency of switching operations railway companies have developed the concept of car blocking. Under this concept, a block of cars, hence the name "blocking", may be logically switched as a unit in a switchyard. A block is established on a basis of certain properties shared by the cars belonging to the block. For instance cars that have a common destination point on their route can be blocked together. A "block" is therefore a logical entity that helps making switching decisions. For reference it should be noted that generally, two types of blocks exist. There is the so called "yard block" and a "train block". For clarity, the term "block" alone in the present specification encompasses either a yard block or a train block.

The principle of blocking, either yard blocking or train blocking increases the efficiency with which cars are processed at switchyards. However, it also brings constraints. Very often a train block must be assembled from cars that arrive on different incoming trains. The train block will be complete and available for departure only when all the cars that make up the train block have arrived at the switchyard. If one or more of the cars are delayed the train block cannot be completed and the entire departing train that pulls this train block may leave without the delayed cars. Such occurrence may create a cascading effect throughout entire segments of the railroad network and have significant financial repercussions for the railroad operator. Specifically, it is not uncommon for an operator to guarantee car arrival times to customers and delays incur financial penalties that may be significant.

In general switchyard operations can be classified in two categories. The first category encompasses post-switching activities, in other words activities after a car or a group of cars are switched. The key objective of the post-switching activities is the selection of the classification track in which the car or group of cars will be placed. The second category includes pre-switching activities. Those include, for example, disassembly of the arrival trains into cuts, mechanical inspection of the cuts and other suitable preparation and finally the driving of the cars making up the individual cuts to the switch.

Prior art pre-switching activities are carried on a first-in, first-out (FIFO) basis. In other words, the cars are switched in the order in which they arrive at the switchyard. This is not optimal since in many cases there may be an operational advantage to switch the cars in a sequence that is different from the sequence in which they arrive.

Against this background, it can be seen that a need exists in the industry to develop more refined processes to manage pre-switching operations in a switchyard such as to increase the efficiency with which cars are processed by the switchyard.

SUMMARY OF THE INVENTION

As embodied and broadly described herein the invention includes a system for computing a preferred sequence in which cars in a switching queue of a railway switchyard are to be sequentially switched to classification tracks. The system has a processing entity for determining within a given set of cars at least two possible sequences in which the cars in the set can be switched and applying logic rules for identifying among the sequences a preferred sequence. The system also has an output for releasing data describing the preferred sequence.

As embodied and broadly described herein the invention also includes a method for computing a preferred sequence in which cars in a switching queue of a railway switchyard are to be sequentially switched to classification tracks. The method includes determining within a given set of cars at least two possible sequences in which the cars in the set can be switched, using a computer for identifying among the sequences a preferred sequence, by applying logic rules and releasing data from the computer describing the preferred sequence.

BRIEF DESCRIPTION OF THE DRAWINGS

A detailed description of examples of implementation of the present invention is provided hereinbelow with reference to the following drawings, in which.

Figure 1:
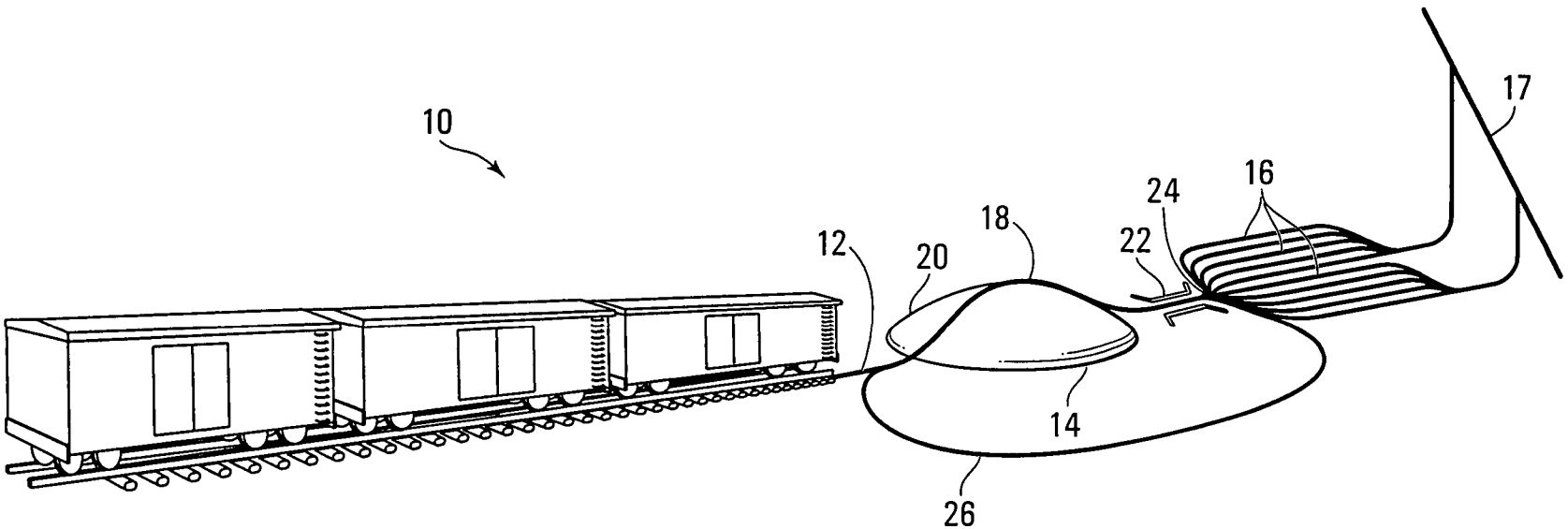
FIG. 1 is a schematical illustration of a hump switchyard.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION

FIG. 1 is an illustration of a hump switching yard in which the management process of the invention can be implemented. The hump switching yard 10 has four main components namely receiving tracks 12, a hump 14, classification tracks 16 and departure tracks 17. The receiving tracks 12 include railway sections in which an incoming train delivers cars to be switched.

The receiving tracks 12 lead to the hump 14. The hump 14 includes a set of tracks 20 that lead to the hump crest 18 that is the highest elevation of the hump 14. Cars are pushed by a locomotive on the tracks 20 up to the hump crest 18 at which point the car rolls down the hump 14 by gravity toward the set of classification tracks 16. The car passes through retarders 22 that will reduce its speed allowing it to gently coast in anyone of the selected classification tracks 16. A track switch 24, located downstream the retarders 22 temporarily connects the hump track 12 to a selected one of the classification tracks 16 such as to direct the car to the desired classification track 16.

The receiving tracks 12, therefore, form a switching queue in which cars that are delivered to the switching yard 10, await to be switched.

The classification tracks 16 lead to the departure tracks 17. Specifically, the classification tracks are arranged into groups, where each group leads to a departure track 17. The hump switchyard 10 shown in the drawings includes 10 classification tracks organized into two groups of five tracks. Each group of five tracks connects to the departure track 17.

Generally, the classification tracks 16 are used to assemble train blocks. Train blocks are pulled out of the classification tracks into the departure tracks 17 where the actual departure train is built. The departure tracks 17 allow assembling trains having more cars than a single classification track can hold. When a complete train (short train) is assembled into a single classification track 16, the departure train leaves that track directly by passing through the departure track 17.

It should be appreciated that FIG. 1 is a very simplified illustration of a hump switchyard in that the number of tracks shown has been significantly reduced for clarity purposes. An average size hump yard typically contains many more classification tracks than what is shown in FIG. 1. For example it would not be uncommon for a switchyard to have 80 or more classification tracks organized into physical groups of tracks, where each group connects to a departure track. In addition, there will normally be a larger number of departure tracks 17 than what appears on the drawing.

The hump switchyard 10 also includes a reswitching track that allows to "recirculate" cars from a position downstream of the switch 24 to a position upstream of the switch 24. In a typical hump switchyard, such as the yard 10 the reswitching track is called "rehump track". The rehump track is shown at 26 in FIG. 1. The rehump track 26 originates downstream the track switch 24 leads to the hump tracks 20 at the base of the hump 14. The purpose of the rehump tracks 26 is to provide a buffering mechanism where one or more cars can be temporarily put in storage without blocking the flow of other cars through the hump switchyard 10. For instance, situations may arise where one or more cars in the receiving tracks 12 cannot be switched in any one of the classification tracks 16. This may be due, for example to the lack of space availability in the classification tracks 16. It is common practice for a hump switchyard 10 to periodically hump the cars in the rehump tracks 26. Such rehumping involves pushing the cars over the hump 14 such that they can be switched to a selected classification track 16. If a car cannot be routed to any one of the classification tracks 16 it is put back in the rehump tracks 26 for a new humping cycle.

The following description of a non-limiting example of implementation of a switchyard management process will be done in connection with a hump switchyard 10 of the type described earlier. However, it should be expressly noted that the principles of the invention apply equally well to a flat switchyard. Accordingly, the invention should not be limited to a hump switchyard but encompasses a flat switchyard as well. A flat switchyard operates generally in the same way as described earlier in that incoming trains deliver cars at the input side of the flat switchyard, a switching device routes the individual cars to classification tracks to assemble departure trains in departure tracks.

Figure 2:
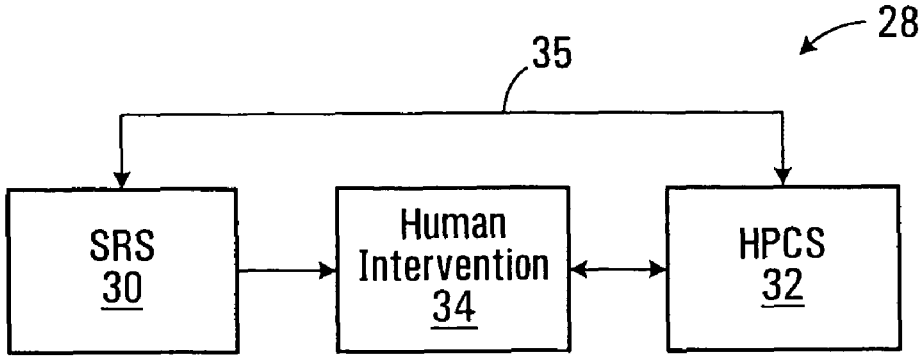
FIG. 2 (Prior Art)
FIG. 2 is a high level block diagram of a prior art computer based switchyard management system.

FIG. 2 illustrates a block diagram of a prior art control system 28 for use in managing the operations of a hump switchyard 10. Specifically, the control system 28 includes two main components, namely the Service Reliability System (SRS) component 30 and the Hump Process Control System (HPCS) 32. The SRS component 30 is in essence a railway traffic management system that keeps track of the rolling stock inventory throughout the rail network. It is used to manage the flow of railway traffic over a complete railway network or a portion thereof. The SRS component 30 is a computer based system that reflects the railway operations by showing information on trains, schedules, waybills, trip plans and train delays. The SRS component 30 has a number of sub-systems that are integrated to one another. Some of the sub-components are briefly described below:

- Waybill—a computer file that provides details and instructions on the movement of cars. Cars and units cannot move without a waybill;
- Service Scheduling—the service scheduling sub-component is based on a trip plan that specifies the events a shipment must follow from origin to destination. A trip plan identifies the train connections for each car and provides a destination Estimated Time of Arrival (ETA). The service scheduling sub-component continuously monitors the movement of each shipment and compares its progress to the trip plan. If the service scheduling determines, that a shipment will not meet the established requirements, it triggers alarms;
- Yard Operating Plan/Daily Operating Plan (YOP/DOP)—the YOP sub-component defines how assets (crews, cars, locomotives and tracks) are allocated to support yard related activities. The DOP is derived from the YOP and contains instructions for industrial assignments;
- Yard, Industry and Train (YIT)—the YIT sub-component allows users to report train and car movements such as train arrivals and departures, yard switches, exchange of cars with other railroads, and the placing and pulling of cars at a customer siding.

Intermodal—this sub-component includes functions for gating-in, gating-out, assigning, ramping, de-ramping as well as maintaining inventories of Intermodal equipment.

The SRS component 30 includes a processing function that is illustrated as a single block, but it can be implemented also in a distributed fashion.

It should be expressly noted that the SRS component 30 is merely an example of a railway traffic management system and other railway traffic management systems can be used without departing from the spirit of the invention.

The HPCS component 32 operates the track switch in the hump switchyard 10. Essentially, the HPCS component 32 is a car switch control system that determines on the basis of inputs the position of the track switch 24 such that a car or a series of cars over the hump, will be directed to the desired classification track 16. Broadly stated, the HPCS component 32 has two main goals, namely:

Deliver the cars to the correct classification track 16;

Insure that the cars will arrive in the classification track 16 fast enough to reach the cars already in the track but slow enough for a safe coupling (or reach the far end of the track if it is empty);

As in the case with the SRS component 30, the HPCS component 32 is illustrated as a single block but it can be implemented in a distributed fashion.

It should be expressly noted that the HPCS component 32 is merely an example of a car switch control system and other car switch control systems can be used without departing from the spirit of the invention.

As shown by FIG. 2 a human intervention 34 is required to interface the SRS component 30 and the HPCS component 32. Specifically, the SRS component identifies the trains that are scheduled to arrive at the hump switchyard 10 and the trains that are scheduled to depart the hump switchyard 10. On the basis of this information a hump list is manually produced. The hump list determines in which classification track the various cars will go. The hump list is then loaded into the HPCS component 32. The HPCS component 32 performs the switching as the cars are humped, according to the specific switching instructions in the hump list. As indicated previously, the prior art technique consists of humping the cars according to a FIFO sequence; the cars that arrive first at the switchyard are likely to be humped first, unless the yard operator decides otherwise. In short the humping operation is largely driven by human judgment and its efficiency is therefore dependent on the experience and knowledge of the operator. In addition, the number of factors that the operator needs to take into account in order to make a decision on the order in which the cars are to be humped is quite large which makes it very difficult to mentally figure what the optimal solution is.

Note the communication link 35 between the HPCS component 32 and the SRS component 30. This link 35 illustrates the exchange of data between the two components, for instance the HPCS component 32 notifying the SRS component 30 of events or conditions occurring in the hump switchyard 10.

Figure 3:
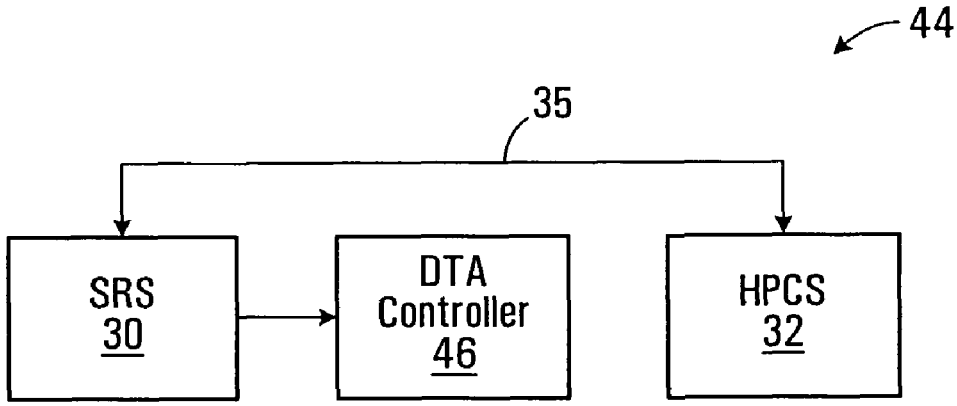
FIG. 3 is a high level block diagram of a computer based switchyard management system according to a non-limiting example of implementation of the invention.

FIG. 3 is a block diagram of control system 44 for use in managing the operations of the hump switchyard 10, according to a non-limiting example of implementation of the invention. The control system 44 includes three-main components two of which are shared with the prior art control system 28 described earlier. Specifically, the control system 44 includes the SRS component 30, the HPCS component 32 and an operations management (OM) controller 46. The controller 46 is responsible for operations in the pre-switching category, such as to identify a preferred car switching sequence. It is also possible to design the OM controller 46 to manage tasks in the post-switching category, without departing from the spirit of the invention. One specific example of a post switching category task that the OM controller 46 can handle, is the allocation of switched cars to classification tracks 16.

Figure 4:
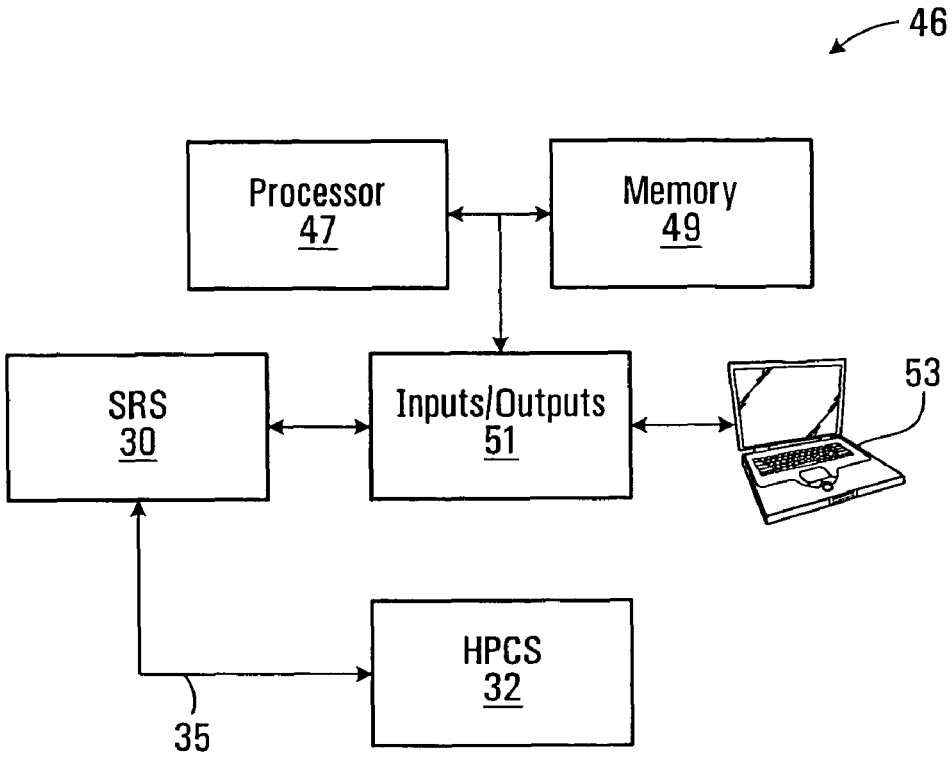
FIG. 4 is a more detailed block diagram of the system shown in FIG. 3.

FIG. 4 is a block diagram of the OM controller 46, showing the relationships with the SRS component 30 and the HPCS component 32. The OM controller 46 has a computing platform including a processor 47 that communicates with a machine readable storage unit 49, commonly referred to as "memory" over a data bus. Inputs and outputs (I/O interface) 51 allow the OM controller 46 to receive and send data to the SRS component 30 and the HPCS controller 32, via the SRS component 30. In addition, the I/O 51 communicates with a user interface 53 that allows the OM controller 46 to communicate information to the yard master and receives commands or other inputs from the yard master. In essence, the user interface 53 shows the yard master recommended hump sequences and switching (assuming that the OM controller 46 is provided with functionality to handle the allocation of cars to classification tracks 16) solutions that the OM controller 46 is developing. Those switching solutions can be implemented either automatically, i.e. pending an input from the yard master that stops the process, the proposed switching solutions are executed, or they may require explicit confirmation from the yard master. For instance, unless the yard master inputs at the user interface 53 a command to explicitly implement or authorize the switching solution presented by the OM controller 46 on the user interface 53, no action is taken by the system.

Note that while the diagram at FIG. 4 depicts the OM controller 46 as a single unit, it can also have a distributed architecture without departing from the spirit of the invention.

The functionality of the OM controller 46 is software defined. In other words, the logic that computes preferred humping sequences and also that determines how cars are to be switched is implemented by executing software by the processor 47. The software in the form of program code is stored in the memory 49. The software reads data inputs received from the SRS component 30, and from the user interface 53. On the basis of those inputs, the OM controller 46 generates outputs to the user interface 53. The output to the user interface 53 is intended to display information to inform the yard master on the recommended hump sequences and switching solutions the OM controller 46 has reached. Optionally, an output may also be directed to the HPCS component 32, which contains switching commands that determine the positions of the track switch 24 and effectively implement the switching solutions developed by the OM controller 46.

In the example illustrated in FIG. 4, the OM controller 46 logically resides between the SRS component 30 and the HPCS component 32. As such the OM controller 46 receives information from the SRS component 30 about:

Incoming trains (trains to be received in the hump switchyard 10), in particular:

Identification of the train (Train ID)

The Expected Time of Arrival (ETA);

Point of origin;

Destination;

Identification of the train blocks that make up the train.

Departure trains (trains the switchyard 10 is expected to assemble);

Identification of the train (Train ID;

The Expected Time of Departure (ETD);

Identification of the train blocks that make up the train.

In order to make hump sequence recommendations and classification track assignments to individual cars, the OM controller 46 creates representations in the memory 49 of the rolling stock that transits through the hump switchyard 10 by using hierarchal objects. Generally, three types of objects exist:

A train object. A train object is associated with each train (arrival train or departure train) and it has properties such as:
- A train identifier (train ID);
- Expected time of arrival (ETA);
- Origin;
- Destination;
- Route; and
- Identification of train blocks that make up the train.

A train block object. A train block object is associated with a block of cars and has the following properties:
- A train block identifier (train block ID);
- Number of cars making up the train block;
- Identity of the cars making up the train block;
- Destination of the train block; and
- Route of the train block from the origin to the destination.

A yard block object. A yard block object is associated with a block of cars and has the following properties:
- A yard block identifier (yard block ID);
- Number of cars making up the yard block;
- Identity of the cars making up the yard block;
- Origin of the yard block;
- Destination of the yard block; and
- Route of the yard block from the origin to the destination.

Car objects. A car object is associated with a single car and has the following properties:
- Car identifier (car ID);
- Car owner;
- If car carries cargo the type of cargo;
- If car is empty the customer identifier that has requested the car to be moved;
- Origin;
- Destination; and
- Route between origin and destination.

Normally, train objects that represent incoming trains will cease to exist when the train arrives at the hump switchyard 10 since the train is dismantled. An exception to this is a situation where the incoming train transits through the hump switchyard 10 in which case it remains intact. Departing trains are represented by train objects that begin their existence at the hump switchyard 10, having been assembled from cars that originate from one or more dismantled incoming trains. Incoming train block objects may cease to exist if the train block is disassembled and the individual cars are used to make up other train block objects. For example a train block arriving at the hump switchyard 10 may contain cars having different destinations. For the sake of this example, say that half of the cars need to be delivered to city A while the other half to city B. In such case the train block is disassembled and the cars that go to city A are switched to form, alone or in combination with other cars from a different train, a new train block that will travel to city A. The cars directed to city B are switched in a similar manner. In this situation, two new train blocks are created at the hump switchyard 10, from one or more incoming train blocks. Another possibility is for train blocks to be modified, instead of ceasing to exist or beginning to exist. A train block can be modified by augmenting the train block, such as by adding to it one or more cars or diminished by removing from it one or more cars. Finally, a train block may remain unchanged such as when it simply transits through the hump switchyard 10. In such case, the train block is physically dismantled into individual cars but the switching operation is conducted such as to reassemble the original train block. Alternatively, the train block can be routed directly to the departure tracks 17 such as to circumvent the switch 24.

As far as individual car objects, they remain unchanged as they transit through the hump switchyard 10.

The OM controller 46 receives from the SRS component 30 data that describes the incoming trains so that the OM controller 46 can determine the details of the rolling stock to be processed. The OM controller 46 also receives information on the departure trains that the hump switchyard 10 is expected to assemble.

In a specific example of implementation, the OM controller 46 receives form the SRS component 30 the following information:

The trains scheduled to arrive to the hump switchyard 10. The SRS component 30 simply provides the identity of the train (the train ID);

The trains that the SRS system expects the hump switchyard to make. The SRS component simply provides the identity of the train (train ID).

Once the OM controller 46 is made aware of incoming trains and the requirement to build departure trains, the train ID information allows the OM controller 46 to determine all the necessary information down to the individual car. More particularly, the train ID allows determining the properties of the train object and the properties of the train block objects derived via the train object and the properties of the car objects derived via the train block objects. This data will then allow the OM controller 46 to compute switching solutions.

It should be expressly noted that the above description of the manner in which information is provided to the OM controller 46 is strictly an example and should not be constructed in any limiting manner. Many different ways to deliver information to the OM controller 46 exist that allow characterizing the incoming trains and the departing trains without departing from the spirit of the invention.

A detailed example of a recommended hump sequence computation by the OM controller 46 will be described below in conjunction with the process flowchart in FIGS. 5 and 6.

Figure 5:
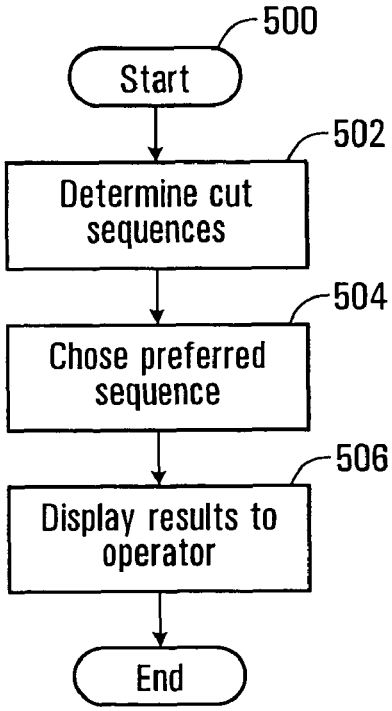
FIG. 5 is a flowchart of a process for identifying a preferred sequence in which cars are to be switched at the switchyard.
Figure 6:
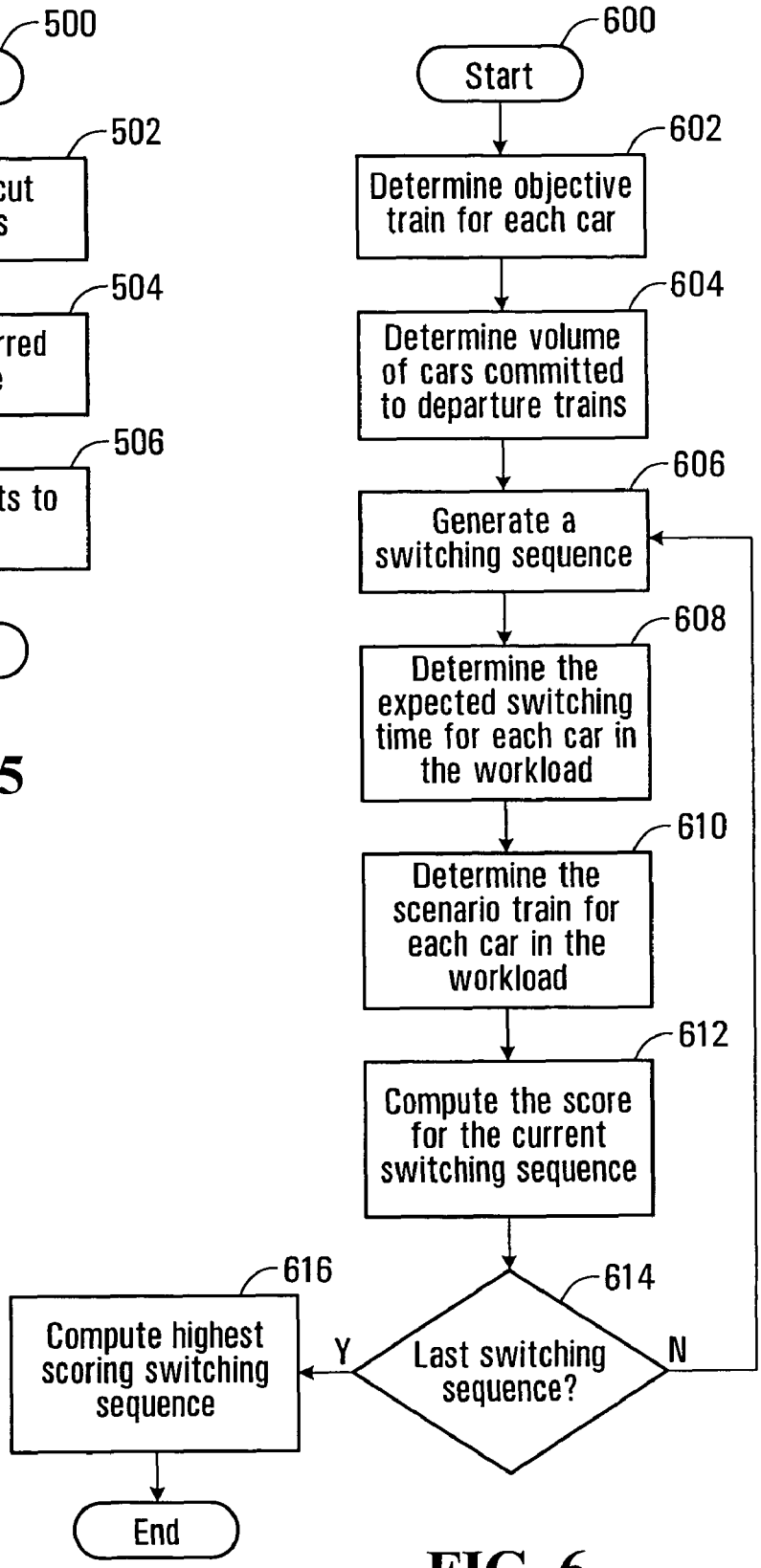
FIG. 6 is a more detailed flowchart of the process shown in FIG. 5.

The flowchart at FIG. 5 illustrates generally the steps of an example of the process for finding a preferred switching sequence of cars. For the purpose of the following description note that the expressions "humping sequence" and "switching sequence" may be used to designate the same or similar process but the expressions have a different scope. "Humping sequence" refers to a sequence of cars processed in a hump switchyard, such as the one shown at FIG. 1. "Switching sequence" on the other hand is more general and refers to a sequence of cars to be processed either in a flat switchyard or in a hump switchyard.

The process includes a start step 500 that is followed by step 502 during which a number of possible sequences in which the car cuts can be switched. For example, if three car cuts exist, say cut 1, cut 2 and cut 3, a first switching sequence may be cut 1, cut 2 and cut 3, a second possible switching sequence can be cut 2, cut 1 and cut 3, a third possible switching sequence can be cut 3, cut 2 and cut 1; etc. While it is possible at this stage to determine all possible sequences of cuts this is not an absolute requirement. In fact, for large number of cuts that exist in the switching queue and await switching, the determination of all the possible permutations may lead at the next step of the process that is described below to a heavy computational burden, which may not be required in practice. Generally, the number of sequences that will be determined in order to find a preferred sequence is dependent on the computational resources available. At least two sequences need to be available in order to choose a preferred one, but in most practical cases more sequences will be considered to make a choice.

At step 504 the cut sequences determined at the earlier step are evaluated and a preferred sequence is selected. By "preferred" is meant a sequence that offers an advantage over another sequence that is being evaluated. What constitutes an advantage is a matter of choice and dependent on the specific application. For example, if the yard master of the switchyard considers preferable to minimize the time cars spent in the switchyard, the metric that will be used to evaluate the sequences and select the preferred one will be the dwell time of the cars in the switchyard. In such example, step 504 evaluates the different sequences and selects the one that allows reducing the dwell time of the cars in the switchyard.

In another possible example, the metric used to evaluate the sequences is the number of missed connections. By "missed connection" is meant that a car that was destined to be part of a departing train is not available when the train departs. In such case the sequences are evaluated on the basis of missed connections and a preferred sequence is selected.

In many cases, the metric that is being applied may be refined by making a distinction between different types of cars. For example one may want to distinguish between loaded cars which usually have a commitment in terms of delivery date or time to a customer versus empty cars that have no such commitment. If such distinction is made, a higher priority can be given to loaded cars than to empty cars. In the case of the "missed connection" metric, the computation could be done in a way to provide more weight to loaded cars than to empty cars. In this fashion, the resulting switching sequence will tend to favor loaded cars such that they make their connections at the expense of empty cars.

The selection of preferred sequence among the sequences that are being evaluated includes, in one specific example, the computation of a performance status of the switchyard that would be reached for each sequence. In other words, the process will compute a performance status for the switchyard for every sequence and then compare the performance statuses to select the preferred sequence. In one example, when the metric to evaluate sequences is based or factors in car dwell time, the performance status of a given sequence can be expressed as a value that reflects the dwell time of all the cars in the switchyard or a subset of those cars. In the example where the metric is missed connections (or alternatively successfully made connections) then the performance status of a given sequence can be expressed as a value that reflects the number of missed (or realized) connections with departure trains.

At step 506 the results of the evaluation made at step 504 area displayed to a yard master. This is done to describe to the yard master the preferred sequence such that the yard master can use this recommendation into making a final decision on what the switching sequence will be. The description of the preferred sequence can be done in many different ways without departing from the spirit of the invention. For instance, the preferred sequence can be shown on the display of the user interface 53 alone or listed with the other less preferred sequences to show the yard master possible options.

A more detailed example of the process for selecting a switching sequence will now be described in connection with FIG. 6. The algorithm on which the process of FIG. 6 is based determines a preferred sequence in which cuts should be humped in order to maximize a score based on cars making their train connections (in other words, reducing missed connections), when departure trains and blocks of those trains have fixed capacities.

The process starts at 600. During this start step, the yard master will fix the order of the first few cuts to be humped. The process will then consider the remaining cuts and generate possible sequences of those cuts in order to find a preferred sequence. The evaluation of the possible sequences may be limited to a reasonable number according to the computational resources available.

The score for anyone of the given sequences to be evaluated is the total of the score for all the cars in the cut (without intent to be bound by any specific definition, in the railroad industry a "cut" refers to any number of cars attached to be pulled by an engine). Generally, the score for a car depends on the objective departure train and the scenario train for that car and the departure times of these trains.

At step 602, the objective departure train for each car in the cuts being considered is determined. The objective departure train for a car is the one that the car should connect to based on the process standard in the switchyard. For example, that standard may be set such that cars that arrive on an incoming train, that need to be humped, have a minimum of 8 hours to connect to departing trains. The scheduled arrival time of the inbound train is used as the starting point for the connection standard, as long as the train arrived early or within 2 hours of its scheduled arrival. If the train is more than 2 hours late, the actual arrival time is used. For trains that are enroute, the same logic is used. For instance, Expected Time of Arrival (ETA)+8 hours if the train is running more than 2 hours late otherwise Scheduled Time of Arrival (STA)+8 hours.

The information necessary to make the objective departure train determination for each car is made available from SRS 30 (Refer to FIGS. 3 and 4). Also note that since the OM 46 has access to information on incoming trains, it can perform humping sequence optimization on cuts that include cars yet to arrive in the switchyard 10.

After the computation at step 602 is completed the results are stored in the memory 49, such as for example as a list mapping the cars to their respective objective departure trains.

Step 604 determines the volume of cars that are committed to the departure trains. This is done to assess what is the available space in the departure trains for carrying cars yet to be switched. The volume of cars already committed includes:

1. Cars located on the departure yard prior to departure of the outbound train;
2. Cars located on the appropriate classification track, prior to cut-off;
3. Cars specifically selected by the yard operator;
4. Cars placed in outbound status prior to the block-swap cut-off standard (those cars bypass the humping process).

Note: If there are filler blocks, then one cannot assume that these cars are committed to outbound trains, since space on filler blocks depends on future arrivals of core block cars which in turn depends on the hump sequence.

At step 606 a hump sequence is generated. This is done mathematically based on the cuts that are to be evaluated. The following steps 608, 610 and 612 evaluate the sequence. This loop is repeated for all the sequences to be evaluated and a final selection is made later at step 616.

For the sequence selected at step 606, the expected switching time for each car in the cuts is determined. The selected sequence is the sequence of cuts which may be cuts that are presently in the switchyard and await switching, cuts on the rehump tracks or cuts expected to arrive (enroute trains).

The computation of the expected switch time for a given car is an approximation of the time at which the car is expected to be available for switching. Several factors can be used in making this determination, for example:

a. The number of cars that are presently in the hump switchyard 10 and that are yet to be switched;

b. The rate or arrival of cars in the switchyard;

c. The rate at which cars are switched;

d. Resources available to prepare the cars for switching.

Factor (a) and factor (b) allow determining, at any given time, how many cars will be in the queue awaiting switching. Recall that this information is readily available to the OM controller 46 from the SRS component 30. Factor (c) can be a rate computed on the basis of the operations in the hump switchyard 10 that occurred in the past couple of hours. For example, a car switching rate can be computed on the basis of the number of cars switched in a given time frame, say the last two hours. A car switching rate can also be computed theoretically by taking into account resources available (factor d) in the switchyard to perform the operations necessary to prepare the cars for switching. One such operation is the mechanical inspection of the cars. One such resource is the number of crews that can perform the preparation for switching, namely the mechanical inspection. By considering the average number of cars that a crew can mechanically inspect it is possible to compute the rate at which cars can be made available for switching. Another possibility is to take into account the rate computed on the basis of switching activities that have occurred in the past previous hours and adjust it to take into account variation in the number of crews, for instance increase the predicted rate if the number of crews increases or decrease the rate if fewer crews will be available.

The OM controller 46 can, on the basis of the above factors, determine for a given car, the number of cars that precede it in the humping queue. Then on the basis of the switching rate, an expected switching time for the car can be computed.

Note that the expected switching time for a given car is dependent on the particular switching sequence determined at step 604. As the sequence changes, the expected switching times for the cars will change since the cars are switched in a different order.

In a specific example of implementation, the following rules are used to compute an expected switch time for each car in the sequence:

1. The earliest expected switch time of a given cut is the inspection end time+30 minutes for a cut in an available status, expected inspection time+30 minutes for a cut in inspection or waiting status or if the train is enroute. Note that for cuts in waiting status the inspection start/end times will be based on crew availability and for trains enroute these will be based on crew availability as well as ETA.
2. The actual expected switching start time of the cut is the greatest of the earliest expected switching start time of the cut as calculated at 1 above and the expected switching end time of the previous cut in the sequence. The expected switching end time of the previous cut is computed on the basis of switching rate parameter (number of cars switched per hour). An example of a switching rate parameter is 125 cars/hour and an example of inspection rate parameter is 60 cars/hour per crew based on two crews.
3. The expected switch time of each car is based on the expected switching start time of the cut and the position of the car in the cut and the switching rate.

After the expected switching time for each car of the sequence has been computed, the process continues with step 610 where a scenario departure train is determined for each car. A scenario departure train is the earliest train with a cut-off time after the car's expected switch time that can carry the car's outbound block, and the train has space for this car.

The assignment of a scenario departure train is an iterative process. The cars are examined in the order of their expected switching time. A car is assigned to the earliest train in a set of candidate departure trains, which has a cut-off time after the car's expected switching time and that can carry the car's outbound block and the train has space for this car, in other words, the train and block capacities have not been exceeded.

Before assigning a scenario train to a car, first, candidate departure trains for that car are determined. A candidate departure train is any departure train that can carry the car's outbound block as a core block or as a filler block and whose cut-off time is after the car's arrival time in the switchyard and the switchyard processing standard, as discussed earlier. Obviously, a candidate departure train also takes into account the destination of the car. Departure trains that cannot carry the car to the intended destination are not considered. Also, departure trains that have a Scheduled Departure Time (SDT). that is before or after the objective departure train's SDT, can be suitable candidate departure trains, hence they are considered when determining the scenario train. However, note that in this example, a departure train that has an SDT that is before the SDT of the objective train can be a suitable candidate departure train only when it can carry the car in a filler block.

The set of candidate departure trains determined for each car may be augmented to include departure trains that depart before the car's arrival time plus the switchyard processing standard. This option may be useful in instances where the car is processed earlier than the switchyard standard and is able to connect to this train.

Before starting the iterative process, the remaining capacities of the candidate departure trains (for all cars) are initialized by subtracting from the actual capacities the space taken up by cars already processed and committed to the trains as per step 604 above.

The iterative process is a series of passes that consider all the candidate departure trains and assign each car to a candidate departure train that becomes the scenario departure train for that car.

The iterative process starts with a first pass. As indicated earlier the cars are examined in the order of their expected switching time. In this pass only those candidate departure trains that have a core block for a car are considered for assignment. For instance, consider the first car of the first cut in the sequence. This car is processed before any other car since it has the earliest expected switching time. The OM controller 46 that has previously identified the candidate departure trains for that car will select the one that has:

1. the earliest cut-off time after the expected switching time of the car; and
2. has a core block for that car.

The selected train by the OM controller 46 is tentatively assigned to the car as a scenario departure train and that departure train and block remaining capacities are reduced by one.

Once the first pass is completed a second pass is initiated which performs a broader assessment and attempts to find space for the car in a departure train either in a core block or in a filler block. The second pass processing first determines if there are any activated filler blocks on anyone of the candidate departure trains determined for the car. If there are no activated filler blocks on anyone of the candidate departure trains then the second pass is not required and the scenario departure train tentatively assigned to the car during the first pass is now confirmed as actual scenario departure train. On the other hand, if there are activated filler blocks on one or more of the candidate departure trains, first a computation is done to assess the capacity of the filler blocks. The capacity of a filler block is computed as the train's capacity minus the space taken up by all the core block cars assigned to this train, such as the cars assigned in the first pass. Note that if more than one filler block for a given candidate departure train has been activated, then the filler block capacity computed above is jointly shared by the several filler blocks and it will be allocated on a First-In, First-Out (FIFO) basis.

The second pass implements a broader assessment because candidate departure trains that include both core and filler blocks are considered for assignment. A car will be assigned to the first eligible train that can carry the car, either in a core block or in a filler block (which implies that the train has sufficient remaining block and train capacity). For example, in a case where a candidate departure train that can carry the car in a filler block but it has a cut-off time that is after the cut-off time of the scenario departure train, then the OM controller 46 will retain the scenario departure train determined during the first pass. However, in an opposite case, where a candidate departure train with a filler block is available and it has a cut-off time earlier than the cut-off time of the scenario departure train tentatively assigned during the first pass, then the tentative solution is disregarded and the scenario departure train assigned to the car becomes the one with the filler block. Once this assignment is made, the train capacities are adjusted. The adjustment includes:

1. reducing the filler block capacity of the newly assigned scenario departure train by one;
2. reducing the train capacity of the newly assigned scenario train by one;
3. increasing the core block capacity of the previously tentatively assigned scenario departure train by one (to negate the previous capacity reduction); and
4. increasing the train capacity of the previously tentatively assigned scenario departure train by one (to negate the previous capacity reduction).

In certain cases a third pass may also be required. For instance, consider the situation where a train TA has a filler block for block B and train TB has a core block for block B and TA departs before TB. Now let's say there is a block C for which the core block is on train TC and a filler block on train TB and TB departs before TC. In such situation, a block B car may shift to train TA and thus release capacity on TB. If block C cars are overflowing TC then they should be shifted forward to TB. For this reason a third pass may be desirable.

In general, the process may benefit from as many additional instances of the third passes as the length of the chain of blocks connected in the way described above, minus one. For instance, if there is a chain of three blocks linked in this way the third pass may need to be repeated twice.

Note that before any instance of the third pass is initiated the capacities of the filler blocks should be updated. This is done by examining the solution from the previous pass as follows:

1. Check for the following three conditions:
   a. There is a train T which has unused train capacity and has an activated filler block for block B;
   b. The filler block is at capacity;
   c. Some cars of block B are assigned to a train that departs after train T (because block B on train T is full);
2. If the conditions under 1 are met then:
   a. New capacity of the filler block on train T is equal to the capacity of the filler block in the previous pass plus the unused capacity of train T.

Finally, a check is performed for a last pass. If at the end of an instance of the third pass the three conditions described above under 1 are met then another instance may be necessary, otherwise not.

Note that even if three conditions are met, it may happen that no car that has been assigned to a later train can shift up to an earlier train (which was underutilized in the previous pass instance) due to expected switching time constraints. In this case there will be no change in train length from one pass to the next. If this condition is verified then no more instances of the third pass are made.

The above described process is repeated for every car in the sequence generated at step 606. So, when step 610 is completed, the OM controller 46 produces a list that associates each car with a given scenario train, as well as the candidate trains and their respective capacities. This list will be used in the next step to compute a score.

Step 612 follows step 610 and computes for each car a score that is used as a basis to rank the various switching sequence. More specifically, step 612 applies scoring rules based on the objective train, the scenario train and the candidate trains for the car. Below is a possible example of scoring rules:

1. If the scenario train is the objective train (successful connection is expected), score =+1;
2. If the scenario train's SDT is before the objective train's SDT, score=+1;
3. If the scenario train's SDT is after the objective train's SDT, and any candidate departing train departs before the scenario train is expected to be under capacity, score=−1;
4. If the scenario train's SDT is after the objective train's SDT, and all candidate trains departing before the scenario train are full, score =0. However, if the scenario train is scheduled to depart within 12 hours after the objective train then the score is=+0.5.

Step 612 computes a score for each car using the above rules. It should be expressly noted that those rules are mere examples and different rules can be implemented without departing from the spirit of the invention.

The step 612 completes by computing a collective score for the sequence generated at step 606. The collective score is the sum of the individual scores of the cars making up the entire sequence. In this example, the collective score expresses the performance status of the switchyard 10 that would be reached should the car sequence be run.

Step 614 is a decision step. If the sequence processed last is the last sequence, in other words step 606 cannot generate any other different sequence, then step 614 is answered in the negative and the process continues at step 616. Otherwise the processing returns to step 606 where a new sequence is generated and processed by steps 608, 610 and 612 as discussed earlier. This continues until all the sequences have been exhausted.

Step 616 compares the collective scores for all the sequences and selects the preferred one. In this particular example, the preferred sequence is the one that has the highest collective score. In other words, the preferred sequence is the one that would put the switchyard in the highest performance status. In the event there is a tie, a possible approach is to select the sequence that has the lowest number of missing connections for certain cars, for example loaded cars versus empty cars. Another possible approach to break the tie is to select a sequence among the sequences that are tied that is closest to the current sequence, so as to deviate least from the current yard work plan. Again, the reader will appreciate that other factors can be relied upon in selecting a sequence in the event of a tie, as missed connection or similarity to the current sequence are only examples of metrics that can be used.

The above example of implementation uses a computational method that evaluates all the possible sequences in a given number of cuts. For some applications, in particular those where the number of cuts to evaluate exceeds 10, the computational requirements become significant since the number of possible sequences grows to large numbers. In this case variants can be implemented to reduce the computational complexity. One such variant is the so called "Strong Optimality" (SO) property that can be used to limit the number of sequences that need to be considered. Assume for the sake of this example that sequences of 10 cuts need to be evaluated. An evaluation method based on the SO property does not look only at complete sequences of the 10 cuts. Rather, the method build up from smaller sub-sequences (a sequence of a subset of the 10 cuts) and reduces the search space through evaluation of these sub-sequences.

For the purpose of this example, a sequence is considered Strongly Optimal (SO) if it has the highest score of all other sequences of the same cuts and its hump completion times is not greater than that of any other sequence.

Consider the following example:

If the method is to evaluate 5 cuts—Cut Nos. 1, 2, 4, 6 and 7, there are 5!=120 possible sequences. Let's say S (1, 6, 4, 2, 7) is the score of sequence 1, 6, 4, 2, 7, and T (1, 6, 4, 2, 7) is its completion time. If 1, 6, 4, 2, 7 is an SO sequence then for any other sequence, say 1, 2, 4, 6, 7, S (1, 6, 4, 2, 7) is >=S (1, 2, 4, 6, 7) and T (1, 6, 4, 2, 7)<=T{1, 2, 4, 6, 7)

The SO property implies that an extended sequence derived from an SO sequence will be superior to a similar extension of any other sequence. That is, in the above case the sequence 1, 6, 4, 2, 7, N will be better than the sequence 1, 2, 4, 6, 7, N in terms of score whatever the cut N is.

A point to note is that the SO sequence may not be unique (a tie situation). There can be two or more sequences with the same highest score. In that case a possible approach is to arbitrarily choose one of those SO sequences for further consideration and neglect the remaining ones, or use anyone of the solutions discussed earlier for breaking the tie.

In some cases a possibility may arise that an SO sequence does not exist for a subset of the cuts. In that situation two or more non-Strongly Optimal or NSO sequences will be in existence.

Using the same example as above: Let's say 1, 6, 4, 2, 7 is the sequence with the highest score but its completion time is longer than that of another sequence. That is, S (1, 6, 4, 2, 7)>S(1, 2, 4, 6, 7) but T(1, 6, 4, 2, 7)>T(1, 2, 4, 6, 7). Then both 1, 6, 4, 2, 7 and 1, 2, 4, 6, 7 are NSO sequences. In this case it cannot be said that the score of the extended sequence 1, 6, 4, 2, 7, N is greater than that of 1, 2, 4, 6, 7, N because the hump start time of cut N in the latter case may be earlier. This could avoid some missed connections and increase the additional score associated with the cut N.

When a subset of cuts does not have an SO sequence a set of NSO sequences can be identified such that all other sequences not in this set have both a lower score and a longer completion time than any of the NSO sequences. The number of NSO sequences may be quite large (in the extreme case all possible sequences of a subset of cuts may be NSO).

In order to enhance optimality it has been found advantageous to keep track of all the NSO sequences as the process builds upon them. As longer sequences are being built, the set of NSO sequences can expand or contract. However, in order to limit the computation one possible option is to keep no more than say, 3 NSO sequences for any subset of the cuts being considered, realizing that this may cause some loss of optimality. The choice of the number to keep is a trade-off between computation speed and solution quality.

The process under this variant generates and evaluates sub-sequences in iterations rather than generating complete sequences as in the complete enumeration technique described earlier. It starts by looking at sequences of length 2 in the first iteration, then in the second iteration it looks at sequences of length 3, and so on. One possible implementation is to consider, at most, 10 workloads/cuts for optimization (that is, if the switchyard operator has fixed the hump sequence of the first 3 cuts, say, then the OM controller will determine the best sequence for the cuts numbered 4 through 13).

The sequence generation is described below for the simple case where the SO property holds for every subset of cuts.

1. First Iteration

In the first iteration all 2-cut sequences are examined to determine the SO sequence for each 2-cut combination.

The number of 2-cut combinations is 10C2=(10*9)/1*2)=45.

For each combination all possible sequences are evaluated. For example, for the combination [3, 5] the cost and time of the two possible sequences 3, 5 and 5, 3 is calculated. Let's say the sequence 5, 3 is SO. It is kept as a candidate. The sequence 3, 5 need no longer be considered.

At the end of the first iteration an SO sequence will be available for each of the 45 2-cut combinations together with its cost and time.

2. Second Iteration

In the second iteration 3-cut combinations are evaluated. This is done by extending the SO sequences of the 2-cut combinations determined in the previous iteration and evaluating them to determine the SO sequence for each 3-cut combination.

The number of 3-cut combinations is 10C3=(10*9*8)/(1*2*3)=120.

For any given combination the following process is implemented. Let's say the combination [1, 3, 5] is being considered. By virtue of the SO property only the SO sequence of [1, 3] needs to be evaluated, extended by cut number 5, the SO sequence of [1, 5] extended by cut number 3, and the SO sequence of [3, 5] (which happens to be the sequence 5, 3) extended by cut number 1. The best of these three extended sequences is the SO sequence of cuts [1, 3, 5].

Thus only 3 sub-sequences need to be computed and compared to determine the SO sequence for each 3-cut combination.

At the end of the second iteration an SO sequence will be available for each of the 120 3-cut combinations together with its cost and time.

3. Subsequent Iterations

The subsequent iterations follow a similar pattern. In the kth iteration 10C(k+1) combinations of length k+1 will exist and for each combination one needs to calculate and compare k+1 extended sub-sequences (derived from the SO sequences of the previous iteration).

4. Ninth and Last Iteration

At the end of the 8th iteration 10C9=10 SO sequences of length 9 are in existence. The process needs to calculate and compare 10 extensions i.e. extend each of the 10 SO sequences of length 9 by the remaining cut in order to obtain the optimal sequence of all 10 cuts.

5. Case with NSO Sequences

The method described above is essentially the same even when for a particular combination of cuts there is no SO sequence. The process then keeps all (and in this specific example at most 3) NSO sequences associated with this combination. In the next iteration this will increase the number of calculations and comparisons accordingly. However, at the end of the next iteration it is possible for the number of NSO sequences to increase or to decrease.

Although various embodiments have been illustrated, this was for the purpose of describing, but not limiting, the invention. Various modifications will become apparent to those skilled in the art and are within the scope of this invention, which is defined more particularly by the attached claims.

The invention claimed is:

1. A method for determining an order in which railcars are to be switched in a railway switchyard that has a switch, the method comprising :

a. providing a data processing apparatus including a CPU and a machine readable storage which is encoded with software for execution by the CPU;

b. processing with the software data describing a group of railcars for determining an order in which railcars from the group of railcars are to be switched by the switch, the determining including:

i. identifying among the group of railcars at least two railcar switching sequences;

ii. comparing the least two railcar switching sequences according to a metric;

iii. selecting a switching sequence on the basis of the comparing;

c. outputting output data from an output of the data processing apparatus describing the switching sequence determined on the basis of the selecting.

2. A method as defined in claim 1, wherein the determining includes computing with the software an expected switch time for one or more railcars in a given switching sequence.

3. A method as defined in claim 1, wherein the metric is railcar dwell time in the railway switchyard.

4. A method as defined in claim 1, wherein the metric is a number of realized connections.

5. A method as defined in claim 1, wherein the metric is a number of missed connections.

6. A method as defined in claim 1, wherein the determining includes forecasting a state of the railway switchyard that is to be produced by at least one of the switching sequences.

7. A method as defined in claim 6, wherein the determining includes forecasting a state of the railway switchyard that is to be produced by each one of the switching sequences.

8. A method as defined in claim 6, wherein the forecasting of the state of the railway switchyard includes assigning at least one railcar of a given switching sequence to a departure train.

9. A method as defined in claim 6, wherein the forecasting of the state of the railway switchyard includes assigning at least one railcar of a given switching sequence to a departure train, in a core block.

10. A method as defined in claim 6, wherein the forecasting of the state of the railway switchyard includes assigning at least one railcar of a given switching sequence to a departure train, in a filler block.

11. A method as defined in claim 8, wherein the assigning of at least one railcar of a given switching sequence to a departure train includes determining if the departure train has enough capacity to carry the railcar.

12. A method as defined in claim 1, including transmitting the output data to a user interface for communicating the switching sequence determined on the basis of the selecting to a user.

13. A method for switching railcars in a railway switchyard that has a switch, the method comprising:

a. providing a data processing apparatus including a CPU and a machine readable storage which is encoded with software for execution by the CPU;

b. processing with the software data describing a group of railcars for determining an order in which railcars from the group of railcars are to be switched by the switch, the determining including:

i. identifying among the group of railcars a plurality of railcar switching sequences;

ii. comparing the railcar switching sequences according to a metric;

iii. selecting a switching sequence on the basis of the comparing;

a. switching railcars from the group of railcars by the switch according on the basis of the selecting.

14. A method as defined in claim 13, wherein the determining includes computing with the software an expected switch time for one or more railcars in a given switching sequence.

15. A method as defined in claim 13, wherein the metric is railcar dwell time in the railway switchyard.

16. A method as defined in claim 13, wherein the metric is a number of realized connections.

17. A method as defined in claim 13, wherein the metric is a number of missed connections.

18. A method as defined in claim 13, wherein the determining includes forecasting a state of the railway switchyard that is to be produced by at least one of the switching sequences.

19. A method as defined in claim 13, wherein the determining includes forecasting a state of the railway switchyard that is to be produced by each one of the switching sequences.

20. A method as defined in claim 18, wherein the forecasting of the state of the railway switchyard includes assigning at least one railcar of a given switching sequence to a departure train.

21. A method as defined in claim 18, wherein the forecasting of the state of the railway switchyard includes assigning at least one railcar of a given switching sequence to a departure train, in a core block.

22. A method as defined in claim 18, wherein the forecasting of the state of the railway switchyard includes assigning at least one railcar of a given switching sequence to a departure train, in a filler block.

23. A method as defined in claim 20, wherein the assigning of at least one railcar of a given switching sequence to a departure train includes determining if the departure train has enough capacity to carry the railcar.

* * * * *